United States Patent [19]

Schut

[11] Patent Number: 4,737,072

[45] Date of Patent: Apr. 12, 1988

[54] CENTRIFUGAL PUMP

[75] Inventor: Theo Schut, Nieuw-Lekkerland, Netherlands

[73] Assignee: IHC Holland N.V., Papendrecht, Netherlands

[21] Appl. No.: 9,046

[22] Filed: Jan. 29, 1987

Related U.S. Application Data

[63] Continuation of Ser. No. 777,040, Sep. 17, 1985, abandoned.

[30] Foreign Application Priority Data

Sep. 20, 1984 [NL] Netherlands ..... 8402886

[51] Int. Cl.[4] ..... F01D 11/00

[52] U.S. Cl. ..... 415/170 A; 415/172 R

[58] Field of Search ..... 415/170 R, 170 A, 172 R, 415/173, 174, 206, 213 R, 203, 212 R, 110, 111, 213 B, 215

[56] References Cited

U.S. PATENT DOCUMENTS

| | | | |
|---|---|---|---|
| 1,555,023 | 9/1925 | Prokofieff | 415/170 A |
| 1,998,611 | 4/1935 | Ford | 415/172 |
| 2,013,499 | 9/1935 | Meckenstock | 277/95 |
| 2,865,300 | 12/1958 | Garris | 415/173 R |
| 2,875,697 | 3/1959 | Fernstrum | 415/112 |
| 2,897,917 | 8/1959 | Hunter | 415/168 |
| 3,381,617 | 5/1968 | Wright | 415/197 |
| 3,413,926 | 12/1968 | Ayson | 415/170 A |
| 3,487,784 | 1/1970 | Rafferty et al. | 415/119 |
| 3,732,028 | 5/1973 | Heynemanns et al. | 415/197 |
| 4,099,890 | 7/1978 | Murakami et al. | 415/170 A |

FOREIGN PATENT DOCUMENTS

| | | | |
|---|---|---|---|
| 104270 | 6/1939 | Australia | 415/174 |
| 1048479 | 1/1959 | Fed. Rep. of Germany | 415/209 |
| 904221 | 10/1945 | France . | |
| 1015158 | 7/1952 | France | 415/201 |
| 624348 | 9/1961 | Italy | 415/174 |
| 7315354 | 5/1975 | Netherlands . | |
| 7604431 | 11/1976 | Netherlands . | |
| 283869 | 6/1952 | Switzerland | 415/172 |
| 685455 | 1/1953 | United Kingdom . | |
| 805824 | 12/1958 | United Kingdom . | |
| 860456 | 2/1961 | United Kingdom | 415/174 |

*Primary Examiner*—Robert E. Garrett
*Assistant Examiner*—John T. Kwon
*Attorney, Agent, or Firm*—Young & Thompson

[57] ABSTRACT

Centrifugal pump, in particular dredging pump for fluids containing abrasive solids and at times larger pieces, having an impeller closed at its two sides, which impeller is journalled at its two sides directly in the pump housing or extensions of the housing, without making use of separate bearing blocks; at the suction side of the impeller the bearing surface is formed on the outside of an interchangeable suction pipe stub (65) about 0.2–1.0 m or more in inside diameter. At the drive side a corresponding bearing structure (66, 662), fitted with axial bearings (663, 661) is used, all radial and axial bearings being fresh water lubricated and of purposely simple, interchangeable design. Against the closed side walls (61, 63) of the impeller, lip-type water lubricated seals are disposed in the vicinity of the outer diameter of the impeller. The pump housing is a welded substantially concentric cylindrical structure.

4 Claims, 2 Drawing Sheets

CENTRIFUGAL PUMP

This application is a continuation of application Ser. No. 777,040, filed Sept. 17, 1985, now abandoned.

The invention relates to a centrifugal pump, in particular for pumping a mixture of a fluid and an abrasive material, such as a dredger pump, comprising:

a pump housing with at least one pressure connection near the circumference and one central axial suction connection on one side, an impeller, closed on two sides, with blades, with a central inlet opening on one side and means of mounting and driving on the closed side, bearing means for the radial and axial rotatable location of the impeller with respect to the pump housing, sealing means between the rotating and the stationary parts of the pump, designed for and provided with connections for rinsing or lubricating fluid under pressure, and a drive shaft for the impeller.

Pumps of this type are known as sand or dredger pumps and in terms of design are as a rule derived from known pumps and for that purpose adapted in particular for handling fluid mixtures containing abrasive material. In this case a separate bearing block is as a rule used on one side of the pump housing for bearing the pump shaft on whose free end the pump impeller is mounted in an overhanging manner. The pumps of this type are very robustly constructed because it is unavoidable that, in addition to the more or less homogeneous mixture of the fluid and the abrasive material such as sand, clay, chippings, gravel, they also have to handle pieces of wood, large stones and pieces of rock. In order as far as possible to prevent blockage, seizing up and damage, the impellers of this type of pump are therefore closed on two sides and have a relatively small number of blades. In view of the forces which occur the pump housings are as a rule manufactured from cast steel with a spiral housing shape, either with or without an internal lining of wear-resistant material. For the radial and the axial bearing both rolling and sliding bearings are used. In order to prevent wear due to the abrasive material as far as possible, many types of seal have been developed to prevent abrasive material getting in between rotating and stationary pump parts. And to do this, use is made as a rule of rinsing or lubricating fluid which is fed under pressure with a pressure higher than the maximum pump pressure encountered.

From the above it follows that the known pumps for the application described above are complicated constructions which are susceptible to wear, and must be regularly provided with new components because the wear resulting from the abrasive material, especially in the impeller and in the pump housing, just cannot be avoided. Should seals not fulfill the intended purpose or suddenly give way, the pump may fail within a short time and have to be stopped in order to carry out very important repairs and replacements. In this connection it should be borne in mind that in particular pumps are being considered with diameters of the intake opening in the impeller of between approx. 0.2 m and 1.0 m and larger, for which drive power of hundreds to many thousands of kilowatts are necessary.

From the above it follows that the intention of the invention is to achieve an improved access to the components liable to wear and if possible, a longer service life of the parts. In this connection, by limiting the number of components and the variety components, lower cost prices and, in particular, lower exploitation costs can be achieved. Furthermore, it is desired to use less cast steel, a variation in the dimensions of the pump having a considerable cost-increasing effect and, in addition, the delivery times of which are long and the delivery possibilities very limited.

The centrifugal pump described in the introduction is characterised according to the invention in that the pump housing essentially supports the bearing means directly, that the bearing means are of the sleeve bearing type, that the impeller essentially is journalled directly in the pump housing, and that the impeller runs in radial bearings both on its inlet side and on its closed side.

Due to the construction invented, the objectives described above are fulfilled to an important degree. The known special bearing blocks are deficient. Per se, sleeve journalling is known from German Pat. No. 339,137, but in this case a relatively thin shaft is mounted in sleeve bearings on either side of the impeller, but not the impeller itself on either side in the housing itself. The known pump has, in addition, a separate bearing block with sleeve bearings on one side. It is completely new to use the sleeve bearing of the impeller with dimensions in the range stated.

Mounting the impeller exclusively on either side is further known from British Pat. No. 805,824. In this case the bearing on the suction side is situated at a relatively large diameter surrounding the suction opening of the impeller. However, this publication relates to a pump for very special applications such as for corrosive, radioactive and hot media. The bearing is adapted to this purpose in that a hydrostatic bearing is used, with the very small bearing plays this entails. Such a bearing would be completely unusable for rugged dredger pump operation, with contaminated fluid, and regularly occurring heavy impacts. In addition, no hydrostatic bearings have yet been developed of the dimensions necessary for the type of dredger pump concerned.

According to a preferred embodiment, the impeller is provided on its inlet side with a suction pipe protrusion and on the closed side with a tubular protrusion of the same or smaller diameter, the outer circumference of which tubular protrusions forms the radial bearing surfaces.

With the construction described above it is, in addition, possible to achieve a considerably shorter overall length of the pump and its bearing. Of the said pipe protrusions, the one on the suction side is of course internally liable to abrasive wear and will have to be replaced from time to time. It is of advantage to use the same shaft protrusion and its outer surface as the bearing surface for the radial bearing on the suction side, as a result of which the construction is simple and during replacement any wear of this radial bearing surface which has occurred can be remedied at the same time. Both tubular protrusions do not need to be of cast steel, but may be welded constructions.

Preferably the tubular protrusion on the closed side of the impeller is provided with at least one radial flange directed outwards and situated at an axial distance from the impeller, which flange acts as a running face for the axial bearing and location of the impeller with respect to the pump housing.

If abrasive material should nevertheless unexpectedly get into these radial and/or axial bearings, all the bearing surfaces can be replaced by replacing a single component or a small number of components.

This is in particular of advantage if bearing means such as the bearing-rings and/or bearing shells are manufactured from a material such as rubber or a plastic and are lubricated with clean water, and if all bearing means are located in a stationary manner when in operation with respect to the bearing housings, the bearing protrusions of the impeller being journalled in a rotatable manner in the bearing means. In practice it was found that the axial and radial sleeve bearings of the invented construction can be reliably lubricated and cooled with a quantity of clean water in the order of magnitude of a few percent of the pump delivery. The supply pressure of this water should of course always be higher than the pressure of the pump in order to prevent penetration of abrasive material. The use of an auxiliary pump unit is normal in this connection. To prevent leakage of the lubricating water from the bearing housings to the outside, known seals can be used which do not need to be described in more detail.

With reference to the sealing means between the rotating and stationary parts of the pump on the pressure side against the fluid which contains the abrasive material it is of advantage that at least one flexible annular axial sealing ring of the lip type, concentric with the shaft of the pump on each side of the impeller between its side plates and the inside side faces of the pump housing, is fitted between the outside diameter of the impeller and the bearing with its seals, the seal lip being directed towards the impeller and elastically pressed against it, and that additional rinsing fluid such as water at a higher pressure than the pressure of the pump is fed radially inside the sealing ring into the gap between the impeller and the pump housing. Axial seals against the side plates of the impeller are known per se from Dutch Patent Specification No. 157,081. These are, however, of very complicated construction and excessively susceptible to unexpected penetration of contaminants. In addition, they are situated at the minimum possible diameter. In contrast to this, the seals according to the invention are of considerably simpler construction and situated at a much greater diameter, as a result of which not such a large part of the impeller and the housing is exposed to the abrasive action of the pumped mixture. For the rinsing water of the seals more water is required, especially in view of the relatively large diameter, than is necessary for the sleeve bearing of the impeller. In order to avoid more pure lubricating water being consumed than is wanted for the bearings, rinsing water for the seals can be used via separate connections, for which purpose off-ship water is in general usable. This is available in unlimited quantities and should be supplied at a higher pressure than the maximum output pressure of the pump, but with a lower pressure than the clean water supply for the bearings so that sufficient circulation will continue to take place in the bearings.

Finally, it is of advantage if the circumference of the pump housing is internally constructed essentially concentrically and cylindrically, with the exception of the pressure connection(s), and if the pump housing is a welded sheet steel drum with a removable side cover around the outside circumference, and if the internal surface of the pump housing is provided with a wear-resistant lining radially outside the seals. The use of an essentially concentric and cylindrical pump housing results in the considerable advantage that a virtually constant pressure prevails over the circumference so that the seals are uniformly loaded over the circumference. The known undesired considerable local wear of seals can thereby be largely avoided. A further advantage consists in the fact that the pump housing no longer needs to be a cast steel body such as the known spiral housings used as a rule, but that a simple drum designed as a welded construction is possible. The same applies to the removable side cover. In a known manner the interior of the pump housing may of course be lined with a wear-resistant material. It was found that under the operating conditions encountered at most times for this type of pump, the efficiency is not lower as a result of the concentric pump housing used than for a spiral housing, and is even as a rule somewhat better. The yield is lower only in the seldom used range of maximum delivery. The great advantages are, however, the simple construction, the fact that it is not necessary to keep various cast steel spiral housings with differing dimensions in stock and the fact that if necessary different pump dimensions can be constructed and delivered very rapidly and easily. Concentric pump housings are known per se from Dutch Patent Specification No. 275,238, but these are usually used for other types of pumps such as, for example, for induction pumps.

DESCRIPTION OF PREFERRED EMBODIMENTS

Figure 1A:
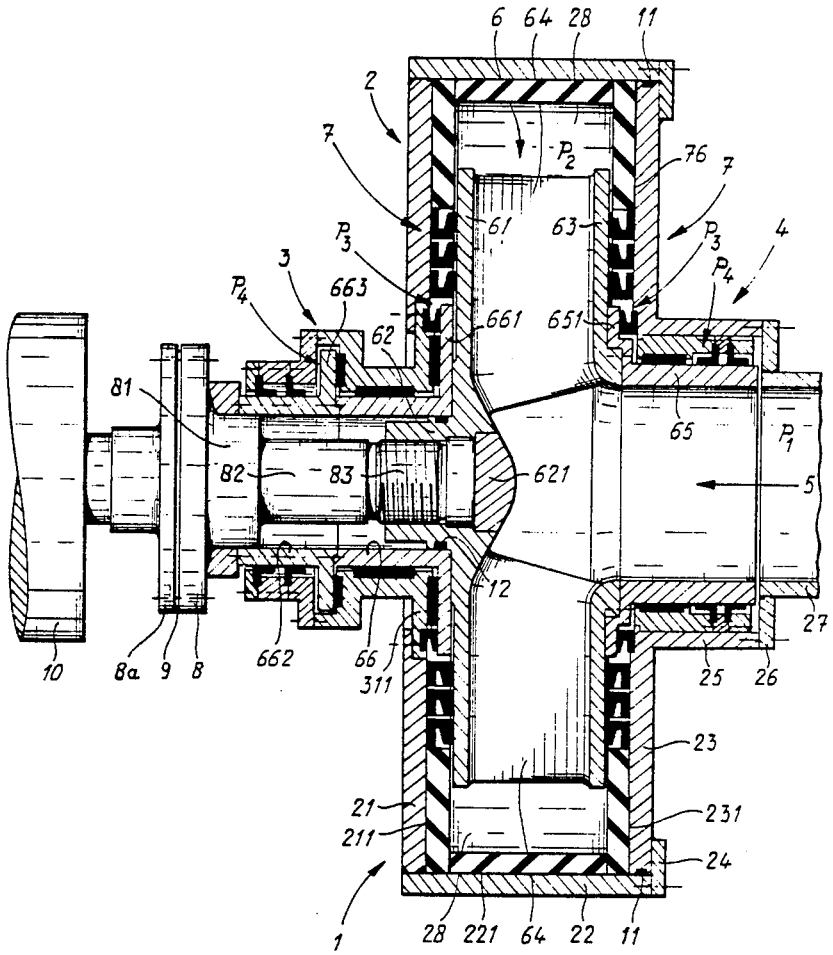
FIG. 1*a* is a cross-sectional view of a centrifugal pump according to the invention
Figure 1B:
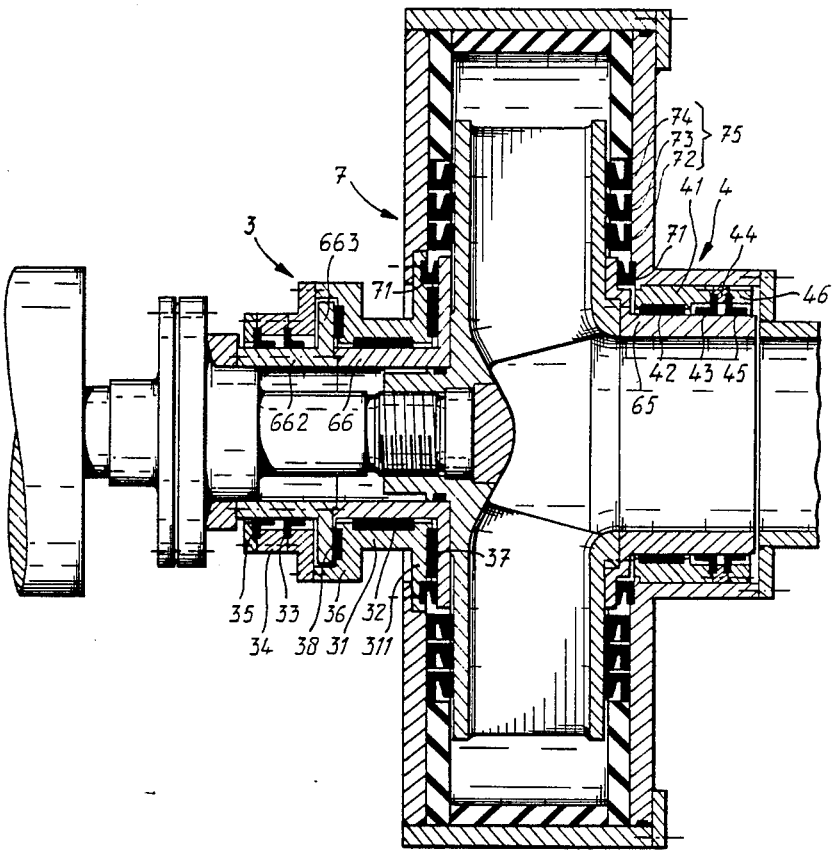
FIG. 1*b* is identical in structure to FIG. 1*a*, but shows some different reference numerals.

The main components are indicated by the numerals 1–10, while for the more detailed description of the components these numerals are followed by one or more subsequent digits. The pump according to the invention is referred to in its entirety by 1. It comprises the pump housing 2. Although this is not shown, it will be clear to the specialist that the mounting means for the whole pump may preferentially be secured to the pump housing 2. On the drive side the pump housing 2 supports a bearing housing 3 and on the suction side a bearing housing 4. Diagrammatically both the direction of flow and the suction opening of the pump are indicated by the arrow 5. The pressure prevailing there during operation of the pump is P1. Mounted in a rotatable manner within the pump housing 2 is the centrifugal impeller 6. In operation this generates a pressure P2 in the pump housing. The impeller 6 is rigidly connected to the flange 8, which drives it, by means of parts described in more detail below.

Via a flexible coupling shown diagrammatically by 9 the drive flange 8 is connected to the driving flange 8*a* which is driven in a rotary manner by the driving device 10 shown diagrammatically. The pump thus forms with its bearing an independent unit without separate bearing blocks and the like. The impeller runs in bearings on both sides. It will be clear that the pump housing is provided with a pressure connection which is not shown. By way of example, it may be supposed that the pump is intended for pumping a mixture of fluid and abrasive material, for example if it is used as a dredger pump. For the type of pump considered the internal diameter of the suction opening 5 is between approximately 0.2 m and 1.0 m or more, while the driving powers are between a few hundreds and thousands of kilowatts. The circumferential speed at the outside diameter of the impeller is in the range between approximately 20 and 30 m/sec.

The supporting element of the pump is the pump housing 2 with a left side wall 21 and a circumferential outside wall 22 rigidly welded to it in which the pressure opening not shown is located. On the right-hand side in the drawing the pump housing is sealed off by the side cover 23 which, by means of a circumferential flange 24 welded to it is secured with diagrammatically shown means of mounting such as bolts or studs and nuts to the circumferential wall 22. A circumferential O-ring seal 11 may be used for the purpose of sealing. In order to make it possible to attach the suction line of the pump firmly to the housing, the right-hand cover 23 is extended with a pipe stub 25 which also serves to accommodate the bearing and seal of the impeller on the suction side to be discussed below. The pipe stub 25 is extended so far that it terminates past the bearing and seal and the ccoperating parts of the impeller.

The flange 26 of the suction line 27 can thus be directly connected to the extension 25 of the pump housing by diagrammatically shown means of mounting such as bolts. The left-hand side wall 21 of the pump housing is provided with a large opening concentric with the rotation axis for accommodating the left-hand bearing housing 3 which will be examined in more detail below. In view of the abrasive properties of the fluid to be pumped the pump housing is provided internally as required with a wear-resistant lining 211, 221, 231 which is of known material and attached in a known manner to the inside walls of the pump housing and the cover. In contrast to most known pump housings, the pump housing is constructed concentrically and cylindrically, which considerably simplifies manufacture because no cast pieces are needed and the pump housing can be constructed in a simple manner from sheet material with welded joints. Because special tools are not needed for the manufacture and machining, it is possible to make changes to the dimensions relatively simply. Replacement is equally simple and as a result the whole design of the pump housing is cheap to manufacture and maintain.

The impeller 6 can rotate inside the pump housing 2. On the left-hand side the impeller consists of a concentric bearing plate 61 in which there is a hub 62 in the centre provided with a hole having an internal thread for accommodating the central clamping bolt for driving and bearing-mounting of the impeller. The central hole is sealed off with a removable plug 621.

On the right-hand side the impeller is sealed off by a plate 63 which extends parallel to the left-hand plate 61. Between the plates there is a number of impeller blades 64, which number is relatively small in view of the medium to be pumped in which there may also be undesired large and coarse contaminants. At the outer circumference the impeller is surrounded by the cavity 28 of the pump housing. In the right-hand impeller plate 63 is the suction opening which is bounded on the right by the suction pipe protrusion 65 which, as a separate component, is secured to the outside edge of the right-hand impeller plate 63 concentrically by means of a locating edge and by means of diagrammatically shown fixing elements such as bolts. The suction pipe protrusion 65 conveys internally the mixture 5 drawn in to the blades of the impeller and its outer circumference is accurately and smoothly machined to form the right-hand radial bearing and seal of the impeller. Because it forms a separate component with respect to the actual impeller 6, it can be manufactured from a suitable material in order to ensure optimum running properties in the bearing.

On the left-hand or closed side of the impeller there is a corresponding tubular protrusion 66 of the same or smaller diameter than the right-hand tubular protrusion 65. In view of the fact that the impeller does not only run on radial bearings on its left-hand side but is also axially located the mounting flange 661 of the left-hand tubular protrusion is made larger than the tubular protrusion 651 on the right-hand side. With a view to easier assembly and disassembly possibilities the left-hand tubular protrusion 66 is constructed of two parts so that it is elongated with a part 662 which supports a flange 663 radially directed outwards which forms the bearing face for the other axial locations. The seals at the same time likewise run on the smoothly machined outer surface, which may or may not be provided with grooves, of the said shaft protrusion elongation 662. A particularly simple, flexible and therefore impact-resistant location which is always correctly aligned is obtained as a result of the fact that the screw end 83 of the central clamping bolt 81–82 is screwed into the hub 62 of the impeller and fully tightened up so that the driving flange 8 of the clamping bolt presses the successive tubular protrusions 662 and 66 firmly against the impeller. The impeller is therefore essentially friction-driven.

The bearing housings 3 and 4 each comprise a bearing bush 32 or 42 respectively for the radial location of the impeller in the housing. These bearings are manufactured in a known manner from rubber or a plastic material with good wear resistance and are suitable for lubrication with water. They are preferably permanently fixed in the bearing housings 31 or 41 respectively so that the water-lubricated bearing gap is located between the inner surface of the bearing rings 32, 42 and the pipe protrusions 66, 65. For the purpose of adequate cooling and lubrication the bearing play should be so large that lubrication grooves in the bearing surfaces are superfluous. In contrast to similar bearings such as are used for propeller shafts of ships having dimensions of the same order of magnitude, the sliding speed when used in the pump is a multiple of that of the known grooved bearings.

The axial location of the impeller takes place in the left-hand bearing housing 3 and in particular by means of two axial bearing rings 37 and 38 which are preferably permanently accommodated in recesses in the flanges 36 and 311 in the bearing housing section 31. They rest with the necessary bearing play against the flange 661 or 663 of the pipe protrusion 66 or 662 respectively. The lubrication with clean water takes place at a point which is indicated diagrammatically by the arrow P4. This clean lubricating and cooling water passes in succession through the axial bearing 663–38, the radial bearing 32–66 and the axial bearing 661–37 in order subsequently to enter, via a lip-shaped sealing ring 71, the chamber into which the rinsing fluid P3 is fed. In the bearing housing 3 flow of the clean lubricating water P4 should not take place to the left so that the known L-shaped seals 33 and 35 act in the same direction against the pressure of the lubricating water P4. In a known manner the L-shaped seal 33 is of a type with a small controlled leak, while the seal 35 should be completely leak-free, but for the purpose of lubrication and cooling must remain wet, which is possible through the controlled leak in the seal 33. By means of a spacer ring 34 the two seals 33 and 35 are kept at a distance from each other. The right-hand bearing housing 4 is simpler because only a radial bearing 42–65 is present in it. The clean water supply takes place as shown diagrammatically at P4, and the circulation through the radial bearing takes place in the direction of the pump housing via the sealing ring 71 towards the supply chamber for the rinsing water P3. In contrast to the left-hand bearing housing 3, in the case of the right-hand bearing housing 4 some water leakage is permissible through the known L-shaped sealing rings 43 and 45. This leakage water mixes with the fluid mixture drawn in by the pump. The lowest pressure in the pump prevails in the suction connection 5 and is P1. The pressure in the chamber 28 around the impeller in the pump housing is P2. Both pressures may of course vary considerably during operation. The supply pressures P3 of the rinsing water and the still somewhat higher pressure P4 of the clean lubricating water should therefore invariably be higher than the pressure P2, possibly by means of a regulating apparatus, but they can also constantly have such a high pressure that it is always higher than the maximum value encountered for P2. P4 should invariably be higher than P3 so that there is a directed flow through the bearings. The clean lubricating water P4 mixes with the rinsing water P3. It is not necessary to impose such high requirements on the rinsing water P3 as regards the purity as on the lubricating water P4. For P3, which should in addition be supplied in considerably larger quantities, off-ship water can in general be used. The reason is that all the abrasive material should be rinsed away as necessary by it together with the lubricating water P4 flowing through, thus keeping this abrasive material always away from the lip seals 72, 73, 74. In view of the dimensions of the pumps concerned, these rings have a relatively large circumference and there should be sufficient rinsing water pressure present with certainty everywhere over the circumference to maintain a flow component directed radially outwards over the whole circumference along all the rings. As a result of this the rings never run dry against the impeller so that their wear remains low and the risk is virtually completely reduced to zero that abrasive material will penetrate in the direction of the bearings. In the figures three separate rings are shown, but it is also possible to combine the rings into a single seal 75 with one mounting side and a number of elastic lips. The ring(s) is/are mounted against the inside of the side walls 21 and 23 of the pump housing. In order to make a long service life and reliable operation possible despite the environment with the abrasive material in the fluid to be pumped and despite the high circumferential speeds at this position of the impeller, the additional rinsing water supply P3 is provided with adequate size. In this connection the concentric cylindrical shape of the internal circumference of the pump housing likewise has a favourable effect because the pressure P2 in the pump housing chamber 28 is virtually identical over the whole circumference. The gap 76 between the outermost end of the impeller plates outside the seals and the pump housing or the wear-resistant lining 211, 231 thereof should be sufficiently large to allow the lubricating and rinsing water to flow through and to prevent smaller abrasive particles permanently lodging therein.

Tests have shown that the simple pump according to the invention with the integral 2-sided bearing of the impeller operates reliably due, among other things, to the separate lubricating liquid supply P4 and the rinsing fluid P3 and promises to have a long service life. Without it being described in detail, it is evident from the drawing that the constructional design in separate parts is such that assembly, disassembly and possibly replacement are easy and that, in particular, the parts subjected to possible wear are relatively small and simple and concentrated in a small number of components.

It will be clear to the expert that P1–P4 indicate both the flow of the medium concerned and the pressure thereof, the point of supply and the means of supply.

I claim:

1. In a medium to large sized centrifugal pump comprising:

a pump housing with at least one pressure connection near the circumference and one central axial suction connection on one side, an impeller, closed on two sides, with blades, with a central inlet opening on one side and means of driving on the other, closed side, water-lubricated bearing means for the axial and radial rotatable location of the impeller with respect to the pump housing, sealing means between the rotating and the stationary parts of the pump designed for and provided with connections for rinsing and lubricating fluid under pressure, and a drive shaft for the impeller; the improvement in which the impeller (6) is provided on its inlet side (5) with a tubular suction pipe protrusion (65) rotatingly fixed to the impeller, the outer circumference of which tubular protrusion forms a radial bearing surface in contact with said bearing means, the pump housing (2) supports the bearing means (3, 4) directly, the bearing means (3, 4) are of the sleeve bearing type (32, 42; 37, 38), the impeller (6) is journalled directly and exclusively in the pump housing (65, 66, 662), the impeller runs in radial bearings both on its inlet side and on its closed side, the impeller (6) is provided on its closed side with at least one tubular protrusion (66, 662) rotatingly fixed to the impeller and surrounding said drive shaft, said at least one tubular protrusion having a diameter no greater than the diameter of the suction pipe protrusion, the outer circumference of which tubular protrusion forms radial bearing surfaces in contact with said bearing means, and a releasable connection between the drive shaft and the impeller, said releasable connection being surrounded and protected by said at least one tubular protrusion.

2. Centrifugal pump according to claim 1, in which the tubular protrusion (66, 662) on the closed side of the impeller (61) is provided with at least one flange (663) directed radially outwards and situated at an axial distance from the impeller, which flange acts as a running face for the axial bearing and location (37, 38) of the impeller with respect to the pump housing.

3. Pump according to claim 1, said rotor having a hub (62) in which said drive shaft (82) is screw threadedly received, said drive shaft (82) having an outer surface which is of substantially less diameter than and spaced radially inwardly from the inner surface of said at least one tubular protrusion.

4. Pump according to claim 1, said at least one tubular protrusion (66, 662) being removably fixed to the impeller.

* * * * *